US011153947B2

(12) United States Patent
Lula et al.

(10) Patent No.: US 11,153,947 B2
(45) Date of Patent: Oct. 19, 2021

(54) DIMMING AND MIXING LIGHT EMITTING DIODES USING REDUCED PULSE WIDTHS

(71) Applicant: Viza Electronics Pte. Ltd., Charlotte, NC (US)

(72) Inventors: Jack Lula, Burlington (CA); Robert Zamora, Huntersville, NC (US)

(73) Assignee: Viza Electronics Pte. Ltd., Charlotte, NC (US)

( * ) Notice: Subject to any disclaimer, the term of this patent is extended or adjusted under 35 U.S.C. 154(b) by 0 days.

(21) Appl. No.: 17/119,828

(22) Filed: Dec. 11, 2020

(65) Prior Publication Data

US 2021/0185780 A1 Jun. 17, 2021

Related U.S. Application Data

(60) Provisional application No. 62/946,741, filed on Dec. 11, 2019.

(51) Int. Cl.
*H05B 45/10* (2020.01)
*H05B 45/325* (2020.01)

(52) U.S. Cl.
CPC ..... *H05B 45/325* (2020.01); *H05B 45/10* (2020.01)

(58) Field of Classification Search
CPC ..... H05B 45/10; H05B 45/32; H05B 45/325; H05B 47/00
See application file for complete search history.

(56) References Cited

U.S. PATENT DOCUMENTS

| | | | | |
|---|---|---|---|---|
| 7,986,102 | B2 | 7/2011 | Roberts | |
| 8,207,691 | B2 | 6/2012 | Slot et al. | |
| 8,288,969 | B2 | 10/2012 | Hsu et al. | |
| 8,299,987 | B2 | 10/2012 | Neudorf et al. | |
| 8,816,604 | B2 | 8/2014 | Carli | |
| 2017/0027032 | A1* | 1/2017 | Kong | G09G 3/32 |
| 2018/0159434 | A1* | 6/2018 | Werner | H02M 3/33561 |

* cited by examiner

*Primary Examiner* — Jimmy T Vu
(74) *Attorney, Agent, or Firm* — Lee & Hayes, P.C.

(57) ABSTRACT

A dimming and color mixing apparatus for light emitting diodes (LEDs) combines constant current distribution with reduced pulse widths. A current source provides a constant source of LED drive current to at least a pair of switches under command of an LED controller. A predefined fraction of the LED rated current that will ensure uniform light output between the LEDs is selected as a minimum drive current to be supplied from the constant current source. The LED controller causes the switches to provide alternating pulses between at least two channels of LEDs according to a switching rate for color mixing, and the current source decreases the LED drive current linearly for dimming. For dimming levels below the minimum drive current, the LED controller decreases the pulse widths in conjunction with the decreased drive current. In one arrangement, for each LED channel the percentage of a duty cycle for the pulsed current is less by a factor of 10 than the percentage of the relative current from the constant current source. The decreased pulse widths lead to increased peak current driven to the LEDs from the constant current source and helps avoid nonuniform light emission when dimming and color mixing the LEDs.

20 Claims, 9 Drawing Sheets

400

500

DIMMING AND MIXING LIGHT EMITTING DIODES USING REDUCED PULSE WIDTHS

CROSS REFERENCE TO RELATED APPLICATION

This application claims the benefit of priority of U.S. Provisional Application No. 62/946,741, entitled "Dimming and Mixing Light Emitting Diodes Using Reduced Pulse Widths," filed Dec. 11, 2019, which is expressly incorporated herein by reference in its entirety.

BACKGROUND

Light emitting diodes (LEDs) are becoming the dominant source of illumination for most applications including, for example, ambient or outdoor lighting, decorative lighting, signage, horticulture, and emergency signaling. Particularly with respect to ambient lighting, the quality and intensity of the illumination provided by the LEDs has attracted significant interest. Users often want the ability to adjust the color temperature and intensity of LED light as desired for reasons of comfort, esthetics, or health.

Providing LED lighting with controllable color temperature can be challenging. In general, to achieve variable color or white point operation, light from multiple banks of LEDs is mixed in a controlled fashion. The banks of LEDs provide variation in part by comprising LEDs having different characteristics, such as LEDs of multiple colors, white LEDs combined with color LEDs, or LEDs of different white points. Blending or mixing the illumination from these differing LEDs can lead to an adjustable color temperature for the light.

While humans are not very sensitive to absolute brightness levels, they are sensitive to lighting color shifts. Achieving a smooth transition when adjusting color mixtures can require many steps to avoid abrupt shifts in the color temperature. Adding to this complexity is that as many as 100 or more fixtures can be visible to a viewer on a commercial building ceiling.

Dimming the light intensity from LEDs can also present challenges. Dimming typically involves reducing the average current driving the LEDs. But modern commercial lighting requirements expect a 100:1 dimming range, with a 1000:1 dimming range required for some applications. Coupling the 100:1 dimming requirement with what may be 100 steps to accomplish smooth color or white-point adjustment requires that the total resolution for each channel of LEDs is on the order of 10,000:1 from the highest current to the lowest current. In addition, these steps must be consistent across fixtures.

This required control resolution is complicated by the fact that LEDs vary in their relative light output for a given current ratio, both between individual LEDs and between strings of LEDs. Typically, LEDs are relatively consistent in relative output from approximately 10%-100% of their rated current. LED to LED variation is more extreme at low current, however, particularly below 10% of the rated current for the LEDs. In many fixtures, large numbers of small LEDs, often more than 100 units, can be used in linear strings or arrays that can cover large lengths or physical areas. When driven with low current, such as less than 10% of what the LED is rated for, individual LEDs can be significantly different in luminance from those around them leading to the overall fixture looking nonuniform or "blotchy" when viewed directly.

Typically, LEDs are "binned" at a specific current during manufacturing, for example, 60% of their rated current. That is, LEDs that have similar light emission qualities at the specific current are grouped together, or binned, to help ensure consistent illumination between them when used at or near the binning current. However, binning only means that the characteristics of the binned LEDs are known at one specific operating current, i.e. 60% of their rated current.

As shown below in Table 1, an LED-1 and an LED-2 that are binned equivalently at 60% of their rated current may have substantial deviations in their relative light output as the drive current decreases. At 100% current, the variation is small. At 10% of full-scale, the output of the two LEDs varies, but the difference is still small. At 1% of full scale, the LED to LED variation becomes more extreme, and at 0.1%, the difference can be large. Moreover, the large string-to-string variation of relative light output at currents below 10% is more evident.

TABLE 1

| RELATIVE LED CURRENT % | IDEAL | LED-1 % | LED-2 % | String to String Variation |
|---|---|---|---|---|
| 100 | 100 | 92.61 | 95.07 | 2.6% |
| 60 | 60 | 60 | 60 | 0.0% |
| 10 | 10 | 8.19 | 8.70 | 5.9% |
| 1 | 1 | 0.586 | 0.704 | 16.7% |
| 0.1 | 0.1 | 0.035 | 0.0534 | 34.1% |

This deviation in relative light output at low currents will result in inaccurate settings of white/color points in color-defined systems, variation in color and intensity between fixtures, and nonuniform illumination or "blotchiness" as described in individual fixtures. To minimize blotchiness and to achieve white and color point control, several methods have been employed.

One option is direct linear mixing, in which separate constant current sources for each string or bank of LEDs is controlled to achieve color mixing and dimming. In short, each constant current source is adjusted linearly to cause a proportional change to the amount of current provided to its respective LED bank, whether for color balancing or for dimming. For instance, if a first LED bank is to be driven with 5% mixing and 1% dimming, its current source would be controlled to provide 1%×5%=0.05% of the rated current to the first LED bank. Although this method is simple, controlling small linear currents can be difficult, which can result in poor color control.

A second option also involves separate current sources for each bank of LEDs, but it achieves color mixing by modulating on and off the current provided by each of the constant current sources. For example, with pulse width modulation (PWM) applied to either or both of the constant current sources, the relative "average" current is determined by the total duty cycle of the PWM current and is controlled to each LED string. However, with PWM, the LEDs when "on" are driven at a higher peak current, such as their rated or binned current.

While this second option can reduce the blotchiness inherent with linear current control due to the higher peak currents, it can have several drawbacks. For instance, if switch-mode regulation is used to control the current to the LEDs, it can be difficult to achieve fine control of the current on each LED string in a repeatable fashion due to limited control loop bandwidth and settling times of the circuitry. Also, the maximum resolution is limited by the PWM rate and the switching frequency. If linear regulation is used, faster settling times are available, but losses in the linear current control elements can lead to low efficiency. Moreover, the circuitry for this second option is higher in cost than for linear control.

In a third option, dimming and color-mixing functionality are separated. A single constant current source drives multiple LED strings, and a control module may linearly adjust the output current based on a desired dimming for the LEDs in the strings. A separate circuit may include switches, typically field effect transistors, that may switch on and off the current from the constant current source for different banks or channels of LEDs based on a desired color mixing.

Because this third method using two stages with TDM and separates the dimming control in the first stage from the color mixing control in the second stage, it is much easier to implement fine control of the division of current. Moreover, the cost to implement this third option is less than the others discussed above. However, some "blotchiness" of the LEDs may occur when dimming at less than 10% of the rated current, as with only linear control, due to the variability of light emission between LEDs at those low currents.

Overall, these options enable moderate control over the color mixing and dimming of LEDs. However, they do not provide enhanced levels of current control needed for avoiding blotchiness in light emission from strings of LEDs at low dimming levels, such as at less than 10% of the LED rated current.

BRIEF DESCRIPTION OF THE DRAWINGS

The detailed description is described with reference to the accompanying figures. The same reference numbers in different figures indicate similar or identical items.

DETAILED DESCRIPTION

Figure 1:
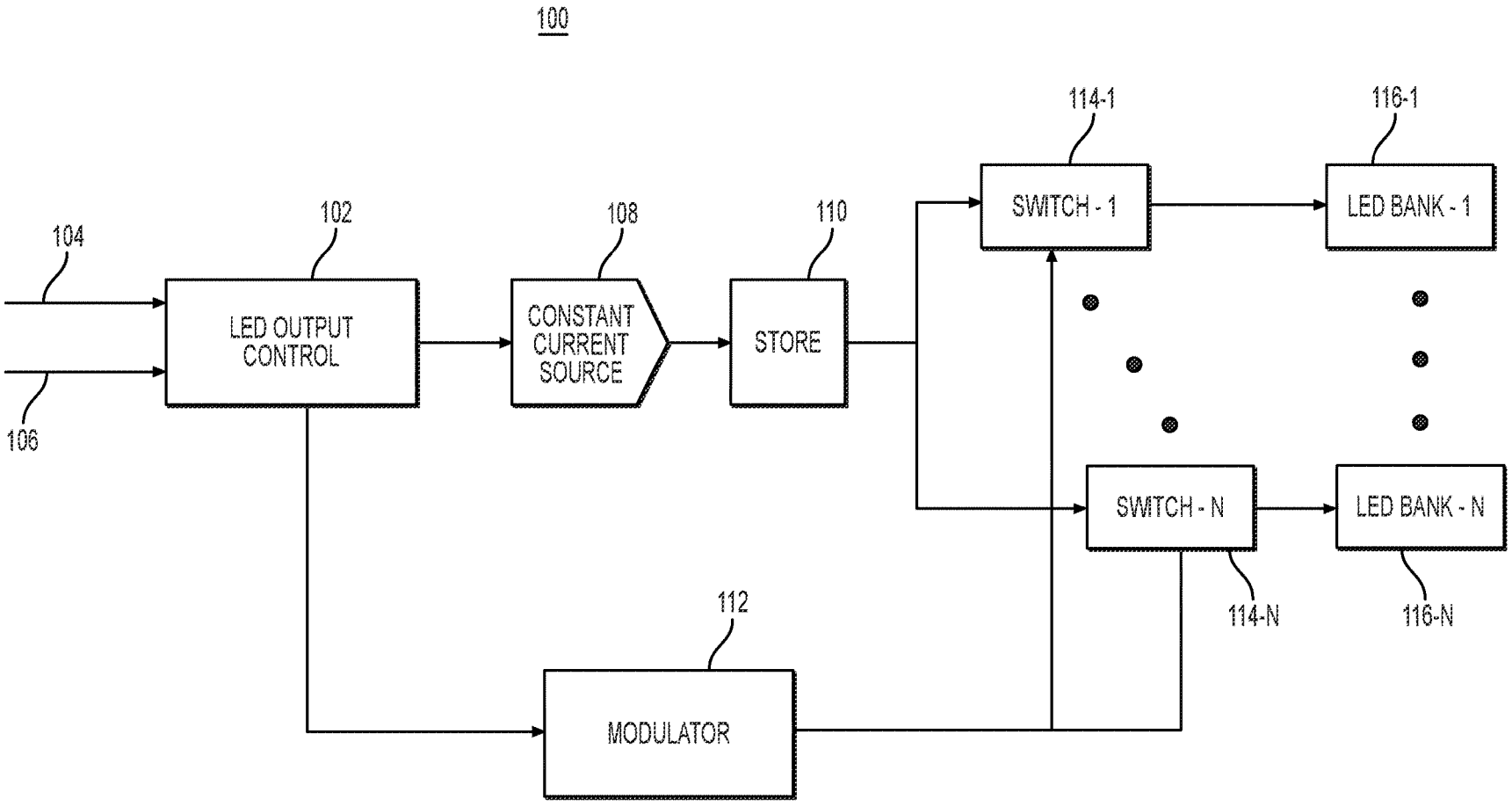
FIG. 1 is a block diagram of a control circuit for color/white point mixing and dimming for multiple LED banks consistent with an example of the disclosure.

This disclosure is generally directed to methodologies for performing color mixing and dimming of at least two channels of LEDs using current distribution with short pulses. As discussed above, the light emitted from two LEDs can vary greatly when those LEDs are driven by currents substantially below their rated currents. As a result, uniform light emission is often difficult to attain across a large quantity of LEDs driven by multiple channels when mixing colors and dimming the LEDs.

To improve the two-stage process of linear dimming and color mixing of banks of LEDs, circuits consistent with this disclosure provide sufficient current to the banks of LEDs using modulation to ensure light emission consistent with their binned values. As discussed above, LEDs are typically binned, or grouped together in manufacturing, such that they have similar light emission (luminance and color) at around 60% of their rated currents. When the drive current for the LEDs is less than about 10% of their rated values, which often occurs conventionally when dimming the LEDs to low light levels, the amount and quality of light emitted can vary significantly between those LEDs, even ones that have been binned together.

To help avoid the nonuniform emission that can arise when dimming LEDs to low levels, circuits and methodologies for operating the circuits consistent with this disclosure ensure that current to the LEDs exceeds a predetermined minimum dimming current. Generally, this minimum dimming current is sufficient for the LEDs to generate light emission consistent with their binned values. Preferably, the predetermined minimum dimming current is about 10% of the rated current for the LEDs.

Based on this minimum dimming current, the control circuitry steers drive current from a constant current source between two or more strings of LEDs for both color mixing and dimming the LEDs. The steered drive current results from modulating current from the constant current source into pulses delivered between the LED strings according to a modulation rate. Unlike with conventional TDM mixing processes where the total "on" time for the strings of LEDs is equal to the modulation period, i.e., the constant current source continuously provides current to one of the LED strings, the methodology consistent with this disclosure provides current to the LED strings that cumulatively is not continuous. That is, the total widths of the pulses delivered to the banks of LEDs during a period of the modulation rate are in total less than that period.

More particularly, the width of the current pulses in the present apparatus for a particular string of LEDs, or the "on" time for a respective LED string, generally complies with the following relationship:

$$\text{Pulse Width}=(\text{Mixing \%}/\text{MixingRate})\times(\text{Dimming-Level}/\text{MinCurrent})$$

As described more fully in examples below, Mixing % refers to the percentage amount of the total current provided to the LED string over time for purposes of color mixing (e.g., 5%), and MixingRate refers to the mixing modulation frequency (e.g., 1 KHz). DimmingLevel is the amount of dimming for the LEDs in terms of the percentage of the rated current (e.g., 1%), and MinCurrent is the predetermined minimum amount of dimming current to be provided to the LEDs in terms of the percentage of the rated current (e.g., 10%). Therefore, at least when a percentage dimming level is below a percentage minimum current level, the methodologies of the present disclosure provide pulses of current to the LED strings smaller than when needed for color mixing alone.

In conjunction with providing current pulses of shorter duration when a dimming level is less than a minimum current level, the control circuitry of the present disclosure, as explained below, is configured and operated in a manner that the current pulses provided to the LED strings provide a larger current amplitude than with mixing alone. Specifically, the control circuitry ensures that current to the LEDs is sufficient in amplitude to generate light emission consistent with the binned values for the LEDs.

Thus, the current pulses—while shorter in duration than pulses from modulated mixing alone—have amplitudes that exceed the predetermined minimum dimming current, which preferably are greater than about 10% of the rated current for the LEDs. As a result, the LEDs may operate within or close to their binned values and do not suffer from the nonuniform emission that can otherwise occur at low dimming currents, such as below 10% of the rated current.

Following the principles of this disclosure, the control circuitry may provide shortened pulses to the banks of LEDs for achieving both mixing and dimming to any level of decreased light emission below full operation at the rated current. Thus, current pulses at different pulse widths and amplitudes may be provided for dimming values from just below the rated current (essentially no change to color-mixing pulse widths due to dimming) to far below the minimum amount of dimming current (large decrease in color-mixing pulse widths due to dimming).

On the other hand, decreased pulse widths with increased amplitude (i.e., combined modulation for color mixing and dimming) may alternatively be provided when a percentage dimming level is desired that is less than the predetermined minimum amount of dimming current. At dimming levels above the predetermined minimum amount of dimming current (e.g., dimming level of 20% with a predetermined minimum dimming current of 10%), the control circuitry may provide dimming to the strings of LEDs using a linear decrease in current output separate without a reduction in pulse widths for color mixing. In this alternative, the pulse width or "on" time for a respective LED string, generally complies with the following relationship:

$$\text{Pulse Width}=(\text{Mixing \%}/\text{MixingRate})\times\text{Minimum}((\text{DimmingLevel}/\text{MinCurrent}),1)$$

Therefore, when the dimming level is greater than the minimum dimming current, the pulse width is determined entirely by the color-mixing operation (i.e., Mixing %/MixingRate). When the dimming level is below the minimum dimming current, the pulse width accounts for both mixing and dimming with the change in pulse width for dimming decreased by the factor (DimmingLevel/MinCurrent).

FIG. 1 is a block diagram of an exemplary two-stage circuit arrangement 100 that supplies current for two or more channels of LEDs in a manner to accommodate variations due to color mixing between the channels and low dimming of the light from the LEDs. As shown in FIG. 1, a first stage of the circuit 100 includes an LED Output Control module 102 that receives inputs relating to color mixing 104 and dimming 106, a constant current source 108 under control of the LED Output Control module 102, and a voltage storage element 110.

As known to those of ordinary skill in the art, constant current source 108, as directed by LED Output Control module 102, provides direct current of a fixed amount to LED strings or banks 116-1 through 116-N that it feeds. In situations described herein, LED Output Control module 102 may adjust the constant current source 108 to decrease its current output linearly with respect to the amount of dimming that is desired for the LEDs.

Alternatively, LED Output Control module 102 may cause an unchanging current to be supplied to LEDs 116-1 to 116-N even during dimming, which can be accomplished through modulation in the manner described in this disclosure. The voltage storage element 110 is coupled to constant current source 108 and, as explained further below, maintains an effectively constant voltage for a given output current, for delivering equal current to banks of LEDs 116-1 to 116-N downstream as they are selectively turned on.

A second stage of the two-stage circuit in FIG. 1 includes a modulator 112, driven by LED Output Control module 102, and switches 114-1 to 114-N each being driven by modulator 112 and each coupled to the output of constant current source 108 and voltage storage element 110 of the first stage. The modulator 112 functions under the control of LED Output Control module 102 to selectively turn switches 114-1 to 114-N on and off to modulate the current provided to each of the strings of LEDs 116-1 to 116-N. Any modulation scheme may be employed, such as PWM or TDM. The modulator 112 provides variable control of switches 114-1 to 114-N to decrease the average current to one or more of LED strings 116-1 to 116-N due to current mixing. In addition, modulator 112 may provide shorter pulse widths consistent with this disclosure to accomplish dimming with less variation of light emission between LEDs for drive current at an amount below a predetermined minimum dimming current.

Each switch 114-1 to 114-N functions under the control of LED Output Control module 102 to pass current from constant current source 108 to a respective LED bank 116-1 to 116-N. To keep the cost of the apparatus low and suitable for mass production, switches 114-1 to 114-N may be field effect transistors (FETs), MOSFETs, bipolar junction transistors (BJTs), or similar devices.

While FIG. 1 illustrates two banks of LEDs 116-1 and 116-N, multiple LED banks or a single LED bank may be used in the implementation of the present concepts. As known to those of ordinary skill in the art, the banks or strings of LEDs 116-1 to 116-N may include a plurality of individual LEDs that are binned with similar luminance and color properties at a set current level, such as 60% of their rated current.

In operation, without any dimming of the LEDs, LED Output Control module 102 controls constant current source 108 to provide a current amount consistent with full light emission from the LEDs, such as their rated current. The LED Output Control module 102 also controls modulator 112 to selectively turn switches 114-1 to 114-N on and off to provide modulation according to a desired color mixing.

With dimming of LEDs 116-1 to 116-N, LED Output Control module 102 may control constant current source 108 to decrease linearly the current provided to the LEDs consistent with the desired dimming level. In parallel, LED Output Control module 102 may direct modulator 112 to selectively control switches 114-1 to 114-N in a manner to modulate the current provided to LED strings 116-1 to 116-N to provide the desired color mixing.

In response to a dimming input 106 indicating to dim the LEDs below a predetermined minimum dimming current, LED Output Control module 102 may direct modulator 112 to selectively control switches 114-1 to 114-N to provide shorten the pulses for color mixing. In particular, LED Output Control module 102 may control modulator 112 so that the current pulses provided to LED strings 116-1 to 116-N are shortened by an amount proportional to the dimming level sought divided by the predetermined minimum dimming current. Accordingly, if the predetermined minimum dimming current is 10% below the rated current for the LEDs and the dimming level sought is 1% below the rated current, source 108 provides 1% of its current level and LED Output Control module 102 may direct modulator 112 to selectively control switches 114-1 to 114-N to provide current pulses of 1/10 the width of what would be required for color mixing alone.

Voltage storage element 110, which is a capacitive circuit, maintains an effectively constant voltage to LED strings 116-1 to 116-N that is a function of the supplied constant current from source 108, the length of the modulation pulses, and the characteristics of the LEDs. For example, if constant current source 108 is to provide 100 mA and the average pulse duty cycle is 50%, then the output voltage from voltage storage element 110 may be 36 V. This voltage would represent the typical LED string operational voltage at 200 mA (100 mA/0.5=200 mA). Similarly, at a constant current of 100 mA and an average pulse duty cycle of 10% for an LED string, the output voltage may be 37 V, representing the typical LED string operational voltage at 1000 mA (100 mA/0.1=1000 mA). Capacitive element 110 maintains the voltage such that when any of current steering switches 114-1 to 114-N are engaged, corresponding LED strings 116-1 to 116-N will all be supplied with the same amount of current.

In one example for this methodology, a minimum dimming current could be set as 10% of the peak current for the LEDs to help deter "blotching" when the LEDs are driven at much lower currents. Consider two strings, LED string 116-1 and LED string 116-N. If a desired dimming level is 1%, LED string 116-1 is set for 5% mixing, LED string 116-2 is set for 95% mixing, and the modulation switching rate is 1 KHz, then the "on" time for LED string 116-1 following the relationship Pulse Width=(Mixing %/MixingRate)×(DimmingLevel/MinCurrent) would be: (0.05/1000)×(1%/10%)=5 pec. The "on" time for LED string 116-2 would be: (0.95/1000)×(1%/10%)=95 pec.

The functionality depicted in FIG. 1 may be embodied in many forms, as known to those of ordinary skill in the art. For example, LED Output Control module 102 may be implemented as electronic control circuitry acting on input signals regarding mixing 104 and dimming 106. Alternatively, the functions of module 102 may be dispersed among other circuit components, such as within constant current source 108 and modulator 112. Similarly, modulator 112 may be implemented in discrete electrical components in a known fashion or in an electronic controller that can process both control information and modulation activities. The precise implementation details do not detract from the principles of the mixing and dimming process of this disclosure.

Figure 2:
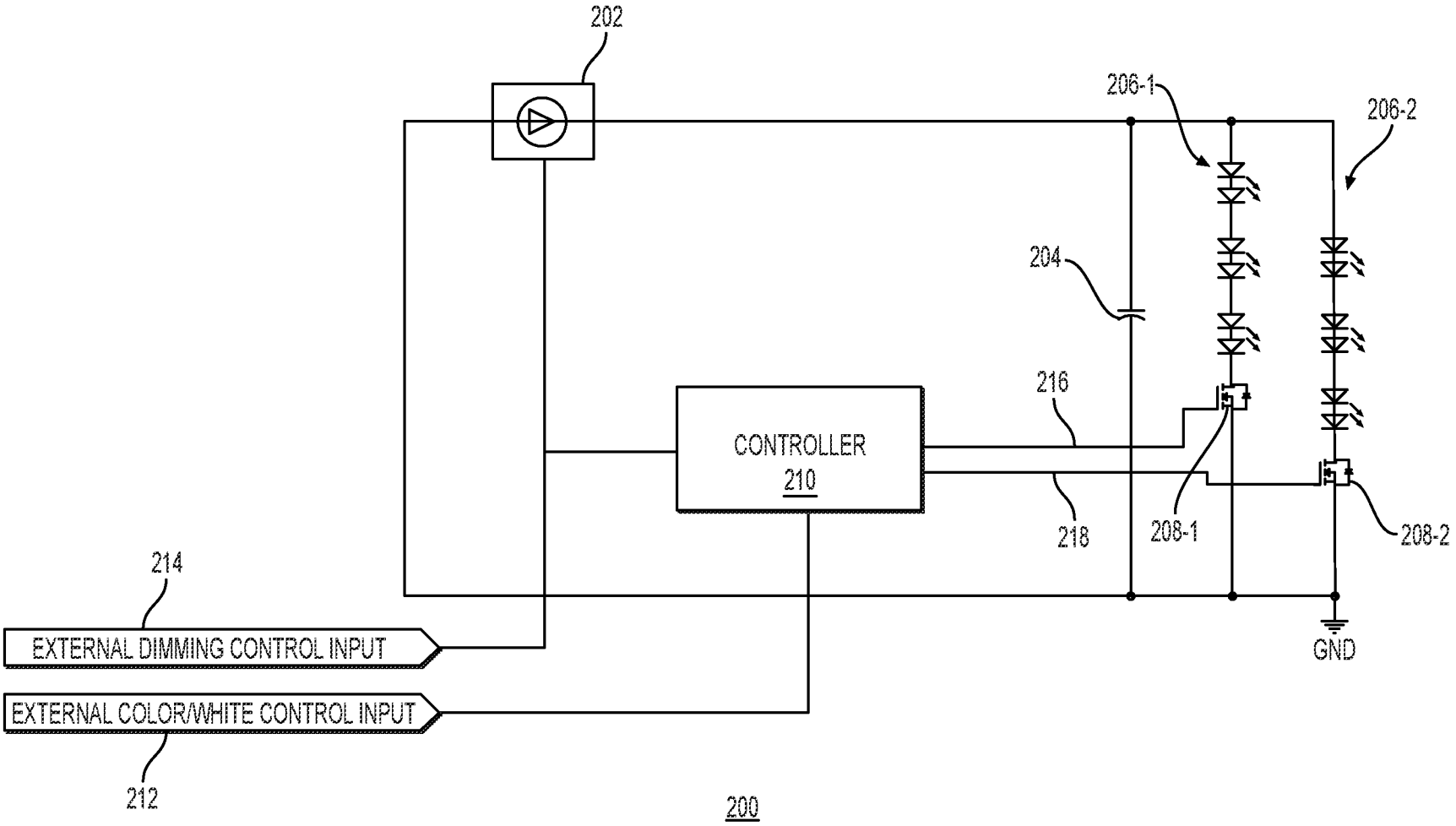
FIG. 2 a general schematic diagram of a mixing and dimming apparatus consistent with an example of the disclosure.

FIG. 2 is a general schematic diagram illustrating one possible apparatus for implementing mixing and dimming consistent with the functional block diagram of FIG. 1. The option of FIG. 2 is intended to provide the disclosed functionality in a simple and low-cost circuit suitable for consumer applications.

As shown in FIG. 2, circuit 200 may include three basic components. First, a constant current source 202 and a voltage storage element 204 may provide a source for substantially constant direct current at a stored voltage level. Second, banks or strings of LEDs 206-1 and 206-2 with associated switches 208-1 and 208-2 may serve as a load for constant current source 202. And third, a controller 210 may process input instructions and provide control pulses or similar signals to switches 208-1 and 208-2.

In further detail, as embodied in FIG. 2, current source 202 may be a device selected and arranged to provide a substantially constant amplitude of adjustable direct current. The amplitude of the direct current may be preconfigured to coincide with rated current for LEDs 206-1 and 206-2. More preferably, current source 202 may be configured to provide different amplitudes on demand to match the parameters of LEDs 206-1 and 206-2, as well as to provide adjustment for linear dimming. As shown in FIG. 2, an external dimming control input 215, for example, may be a signal indicative of the amplitude for current source 202 to provide.

Current source 202 is depicted as a functional element and can be implemented in many ways known to those skilled in the art. Options may include a switch mode current controller such as FL7760 available from On Semiconductor, a linear current source such as AP4312 available from Diodes Inc. controlling an external power transistor, and other combinations of discrete and integrated parts to form a controllable constant current solution.

Circuit 202 further includes voltage storage element 110 connected in parallel with current source 202. In its most simple implementation, voltage storage element 110 is a capacitor. Capacitor 110 will help maintain a constant voltage across LED strings 206-1 and 206-2 at a typical drive value of, for example, 36V, in a manner discussed further below. Alternatively, the capacitive element could be integrated within the current source.

Connected in parallel to current source 204 and voltage storage element 204, two LED strings 206-1 and 206-2 may pass the substantially constant amplitude of direct current from current source 202 and illuminate in a known fashion. To ensure high-quality and balanced luminescence, the LEDs in each string may be chosen to have similar electro-optical characteristics, such as being voltage-matched or binned at common values. For instance, the LEDs may have the same rated current, be binned at a common amperage (e.g., 60% of their rated current), and have similar color characteristics at their rated current. As well, the LEDs in both strings 206-1 and 206-2 may be chosen to share electro-optical characteristics.

In series with LED strings 206-1 and 206-2, respectively, are electronic switches 208-1 and 208-2. To maintain low cost and simplicity, switches 208-1 and 208-2 are preferably field effect transistors and may be MOSFET/BJT devices. Each switch 208-1 and 208-2 functions to open or close a circuit from current source 202 to ground, effectively passing or blocking the flow of current through the respective upstream LEDs 206-1 or 206-2.

Third, electronic controller 210 is configured to selectively enable switches 208-1 and 208-2. Shown as a single device, controller 210 may be a digital microcontroller, such as, but not limited to, one of the XMC1202 family of microcontrollers available from Infineon. The functionality of electronic controller 210 may also be embodied in various forms, including one or more processors and one or more computer readable media that stores various modules, applications, programs, or other data. The computer-readable media may include instructions that, when executed by the microcontroller or one or more processors, cause the processors to perform the operations described herein. In some implementations, microcontroller 210 may include a central processing unit, microprocessor, a digital signal processor or other processing units or components known in the art. Alternatively, or in addition, the functionally described herein can be performed, at least in part, by one or more hardware logic components. Additionally, microcontroller 210 may possess its own local memory, which also may store program modules, program data, and/or one or more operating systems. Alternatively, for an even simpler approach, controller 210 may be implemented in other ways, such as with various digital logic components or as an analog microcontroller, for example.

In some examples, controller 210 may operate to affect the balance of light emission between LED strings 206-1 and 206-2 to achieve color mixing or white-point control in response to external color/white control input 212. For instance, based on mixing input 212, controller 210 may provide modulated signals 216, 218 to switches 208-1 and 208-2 to alter the flow of current through strings 206-1 and 206-2 as instructed. If mixing input 212 was indicative of a desire for 5% mixing on string 206-1 and 95% mixing on string 206-2, controller 210 may generate and provide suitable pulses to each of the switches at a switching rate. A control signal from controller 210 to string 206-1 may be a signal 216 at the switching rate, say 1 KHz, with 5% duty cycle sent to switch 208-1, while another signal 218 at the switching rate of 1 KHz to control switch 208-2 may have a duty cycle of 95%. The inverse of the switching rate may be called the mixing period. Thus, controller 210 may perform functions of modulator 112 in FIG. 1, providing a modulation signal between the two switches 208-1 and 208-2 for color mixing.

In this exemplary arrangement, control signals 216 and 218 are separated between the two LED strings by a form of TDM timing, where the total "on" time for the switches 208-1 and 208-2 is roughly equal to the total mixing period for the modulation signal. That is, the modulation signal to turn "on" each of the strings may be split 5/95 between the strings and the combined width of a first mixing pulse on line 216 to switch 208-1 and a second mixing pulse on line 218 to switch 208-2 may equal the period of the switch rate. Variations to the control scheme for color mixing may be employed in a known manner, including various modulation formats.

Figure 3:
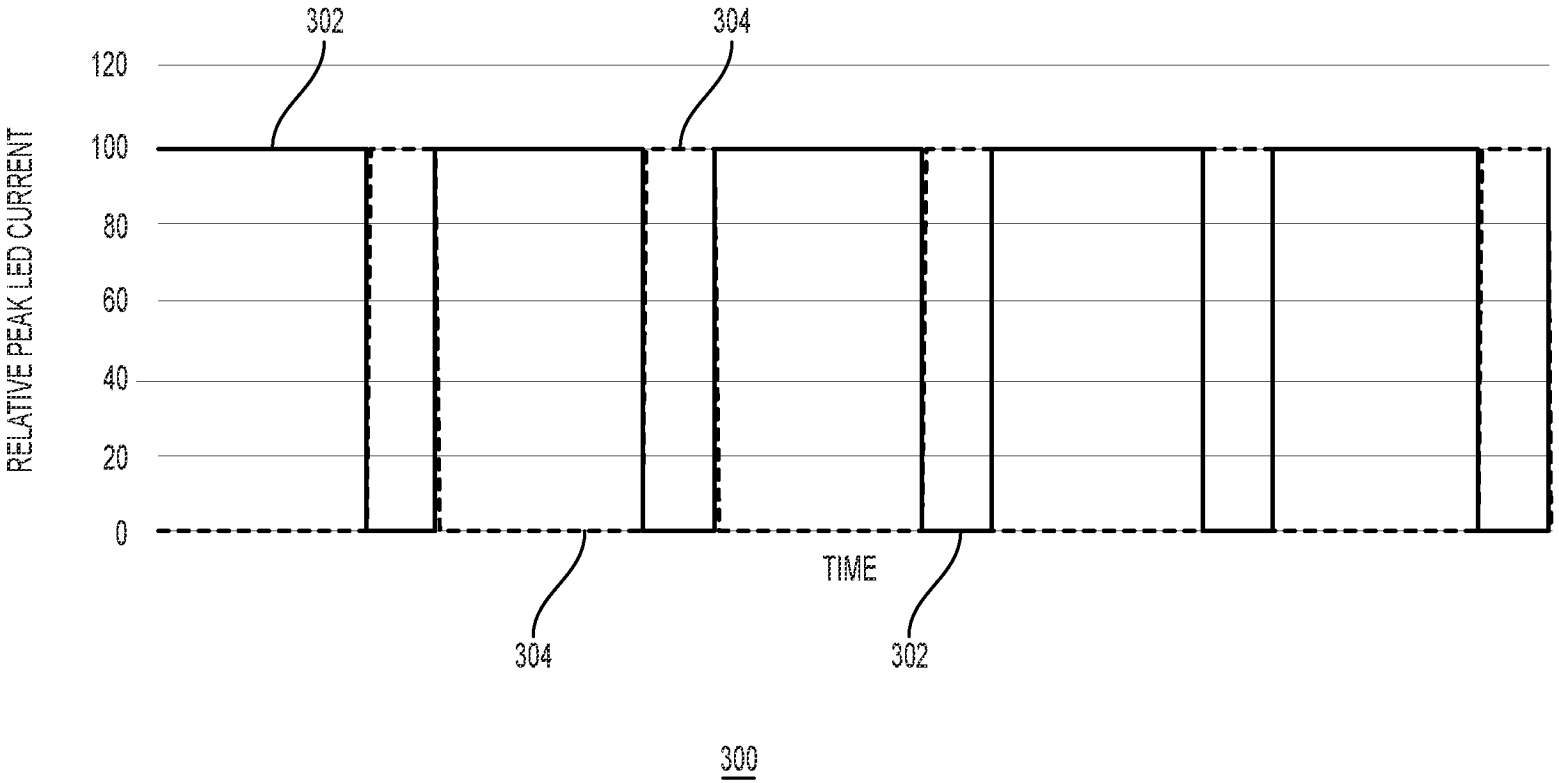
FIG. 3 is a diagram depicting light output over time for two LED channels operated with color mixing using pulse-width modulation and time-division multiplexing.
Figure 4:
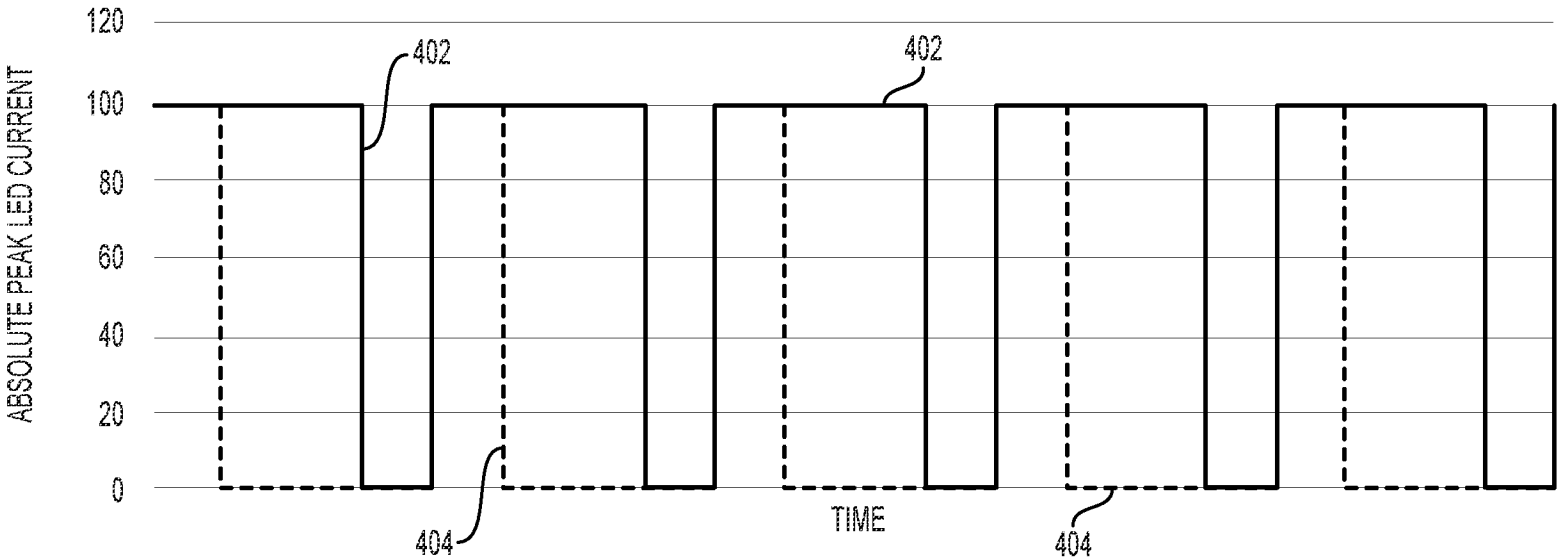
FIG. 4 is a diagram depicting light output over time for two LED channels operated with color mixing using pulse-width modulation without time-division multiplexing.

FIGS. 3 and 4 below are example timing diagrams showing the relative light output of LEDs corresponding to pulse modulation for color mixing generated by controller 210 between strings of LEDs. In particular, FIG. 3 illustrates a timing diagram 300 for light output (and therefore the relative drive currents for each LED string causing the particular color or white point of light output) where LED string 206-1 in solid line 302 and LED string 206-2 in dashed line 304 are driven with PWM modulation and TDM timing. In this context, TDM timing refers to the control signals for LED string 206-1 and LED string 206-2 not being "on" at the same time and the constant current from source 202 being caused to alternate between the LED strings with a total duty cycle of 100%. In some examples, output 302 could correspond to cool-white light, and output 304 could correspond to warm-white light, with the two being color-mixed at an 80/20 ratio.

FIG. 4 illustrates a timing diagram 400 for light output (and therefore the absolute drive currents for each LED string causing the particular color or white point and light output and dimming level) where an LED string 208-1 in solid line 402 and LED string 208-2 in dashed line 404 are driven with PWM modulation but without TDM timing. The pulses for each LED string may be provided simultaneously, as shown, with the total duty cycle still being 100%. In some examples, output 402 could correspond to cool-white light, and output 404 could correspond to warm-white light, with the two being color-mixed at a 70/30 ratio.

As embodied in FIG. 2, in some examples controller 210 may operate in different modes to help effectuate dimming of LEDs 206-1 and 206-2 as well as color mixing. Dimming may occur in a predetermined manner as programmed in controller 210, such as on a timed schedule. More commonly, however, dimming may occur in response to an external instruction, such as from external dimming control input 214.

One dimming mode for controller 210 may correspond to a dimming control input 214 that is indicative of a dimming value for the LEDs to be less than their full rated current but still within their binned ranges, for example at 50% of the rated current for the LEDs. In that dimming range, source 208 would provide a percentage of the full current corresponding to the dimming value to LEDs 206-1 and 206-2, which would provide less than their full illumination according to the dimming value. But at 50% dimming, the LEDs would still be in an operational range in which variation in light emission between the binned LEDs should remain small. Therefore, within this dimming range, which may be deemed a minimum dimming mode, controller 210 may continue to provide mixing pulses in the form noted above and as exemplified in FIGS. 3 and 4.

Another dimming mode for controller 210, which may be deemed a maximum dimming mode, may correspond to a dimming control input 214 that is indicative of a dimming value for the LEDs to be below a predetermined minimum drive current. As discussed above, a predetermined minimum drive current may entail any criteria desired at which poor illumination consistency between the LEDs begins to arise. Typically, a predetermined minimum drive current may be approximately 10% of the rated current for the LEDs, which is a common point at which the variation of light emission between binned LEDs tends to increase. The value 10% is not meant to be a precise and limiting amount. Currents within that range, such as 5-20%, for example, may provide reasonable values at which the variation of light emission starts to increase and could qualify as a predetermined minimum drive current. In implementations having lower tolerance for variation or "blotchiness" in light emission, the predetermined minimum drive current may be selected to be even higher, such as 10-50%. The precise value for predetermined minimum drive current will depend on the situation and is within the experimentation and knowledge of one skilled in the art dealing with different components.

In the maximum dimming mode, current source 202 again linearly decreases the amplitude of the direct current, while controller 210, also acting on dimming control input 214, shortens the duration of the color-mixing pulses. The shortening of the pulses that drive switches 208-1 and 208-2 in the maximum dimming mode increases the current passing through LED strings 206-1 and 206-2 to be at least the predetermined minimum drive current. As a result, even at the lowest dimming levels, LED strings 206-1 and 206-2 will avoid operating below their minimum drive currents where the variation in light emission between LEDs or between strings may be high.

In particular, in the maximum dimming mode in which a desired dimming level requires an LED drive current to be less than a predetermined minimum drive current, controller 210 may cause switch 208-1 to be activated at 216 for a duration that shortens the pulse width for mixing by a factor of the desired dimming level percentage divided by the predetermined minimum drive current percentage. Thus, if the predetermined minimum drive current is 10% of the LED rated current and the desired dimming level is 1% of the LED rated current, then the pulse width for mixing and dimming may be 1/10 of the pulse width for mixing alone.

Other relationships may be used to describe options for decreased pulse widths, or decreased duty cycle, when controller 210 operates in a maximum dimming mode. For instance, if Mixing % refers to the percentage amount of the total current provided to the LED string over time for purposes of color mixing (e.g., 5%), MixingRate refers to the mixing modulation frequency (e.g., 1 KHz), DimmingLevel refers to the amount of dimming for the LEDs in terms of the percentage of the rated current (e.g., 1%), and MinCurrent refers to the predetermined minimum amount of dimming current to be provided to the LEDs in terms of the percentage of the rated current (e.g., 10%), then the pulse width provided to switch 208-1 may have the relationship (Mixing %/MixingRate)×(DimmingLevel/MinCurrent).

Similarly, a relationship may be defined for how controller 210 may be programmed to behave for both the minimum dimming mode and the maximum dimming mode. With minimum dimming mode, in some examples, dimming is controlled by a linear decrease in current from source 202, while the pulse width on 216 is chosen to control color mixing. Therefore, to account for both modes, pulse width provided to switch 208-1 may have the relationship (Mixing %/MixingRate)×Minimum((DimmingLevel/MinCurrent), 1). Following this relationship, for minimum dimming mode, the pulse width is determined entirely by the color-mixing operation (i.e., Mixing %/MixingRate). For maximum dimming mode, when the dimming level is below the predetermined minimum dimming current, the change in pulse width for dimming is accounted for by the factor (DimmingLevel/MinCurrent).

The following example illustrates behavior of circuit 200 as light emission from LEDs 208-1 and 208-2 is progressively dimmed from 100% output to 1% output while color mixing is shared 50% between the channels at a mixing rate of 1 KHz (i.e., a mixing period of 1 msec). The LEDs are assumed to have a predetermined minimum drive current of 10%. As discussed above, during the minimum dimming mode, the pulse width will equal (Mixing %/MixingRate) for color mixing, while during the maximum dimming mode, the pulse width will be decreased by the factor (DimmingLevel/MinCurrent). In conjunction, during the maximum dimming mode, the decreased pulse widths will cause the percentage of peak current passing through the LEDs, i.e. DimmingLevel, to be increased by the factor (MixingPeriod/2*Pulse Width).

In this example, only one channel, such as LED string 206-1, is discussed for simplicity. At 100% output from current source 202, the LEDs will be "on" for one-half the mixing period, or 500 μsec. The peak current will be 100%*(1 msec)/(500 μsec+500 μsec))=100% on each channel. At dimming values within the minimum dimming mode, i.e. greater than or equal to 10% in one example, these relationships will remain the same with the peak current on each LED being essentially equal to the current output from current source 202. That is, 50% output from current source 202 will result in 50% peak current through the LEDs, and 10% output will result in 10% peak current through the LEDs.

At 5% output, circuit 200 would enter a maximum dimming mode where the mixing pulse widths would be decreased in duration. In particular, the pulse width would be decreased by (DimmingLevel/MinCurrent) or ½, to become 250 μsec. The peak current would be increased by (MixingPeriod/2*PulseWidth), or 1 msec/(250 μsec+250 μsec)=2. As a result, at 5% output from source 202, 10% of full current would be present on each channel.

Similarly, at 1% output in the maximum dimming mode, the pulse width would be decreased by 1/10, to become 50 μsec. The peak current, in turn, would be increased by a factor of 10, resulting in 10% of full current passing through the LEDs.

Accordingly, as dimming instructions such as those from 214 indicate progressively decreasing current for source 202, circuit 200 will respond during the minimum dimming mode with linear decreases in current through the LEDs up to a predetermined minimum drive current. When the dimming level drops below the predetermined minimum drive current, controller 210 will decrease color-mixing pulses as a factor of (Dimming Level/MinCurrent), causing an increase in peak current through the LEDs by a factor of (MixingPeriod/2*PulseWidth). The increased peak current will help avoid "blotchiness" of an LED string or larger installation even at the lowest levels of dimming.

Figure 5:
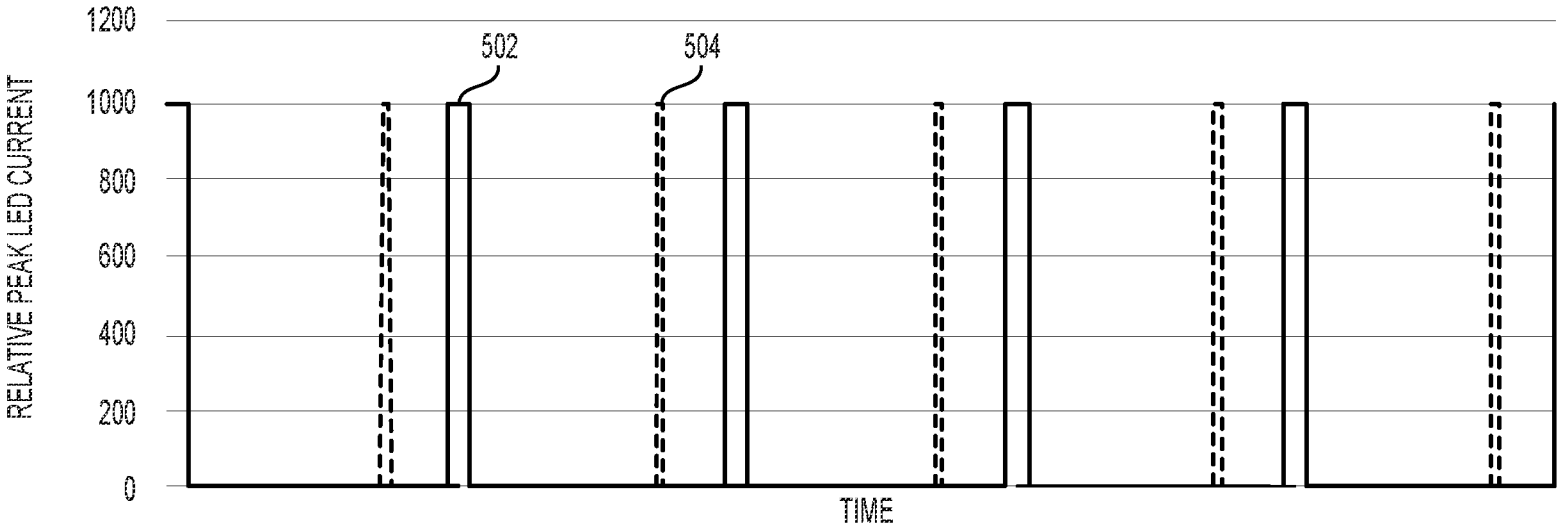
FIG. 5 is a diagram depicting light output over time for two LED channels operated with mixing and dimming consistent with an example of the disclosure.

FIG. 5 is a timing diagram 500 of relative light output over time for LED strings 206-1 in solid line 502 and LED string 206-2 in dashed line for the maximum dimming mode. In this example, a predetermined minimum dimming current is 10% of the rated current, and a dimming level is 1% of the rated current, and both pulse trains use TDM on lines 216 and 218.

As shown in FIG. 5, the resulting pulses for color mixing and dimming are, in general, 1/10 the width of pulses for color mixing alone (i.e., for this example, an "on" time reduction from 50 pec to 5 μsec for the first LED string and from 950 pec to 95 μsec for the second LED string). In addition, the magnitude of the pulses in magnitude are, in general, 10 times the amplitude of pulses for color mixing alone. By operating the LEDs closer to their rated current, blotchiness is eliminated, and the matching between LED strings 206-1 and 206-1 is improved even when dimming occurs at levels as low as 1% of the rated current. The example in FIG. 5 illustrates light output, and therefore drive currents, that are not simultaneous between LED strings 206-1 and 206-2. Therefore, the example of FIG. 5 may be characterized as PWM having TDM timing, as the drive current is switched between the two strings.

Consequently, this improved methodology provides a total "on" time for the switches that is less than the total mixing period according to the switching rate. Moreover, the "on" duty cycle, when viewed as a ratio of the total current, is preferably less than the ratio of the relative current for each of the channels. By example:

LED1=10% relative current

LED2=90% relative current

LED1 duty cycle is <10%, i.e. 1%

LED2 duty cycle is <90%, i.e. 9%

Therefore, as indicated, in one implementation, the percentage of the duty cycle for the current driving each of the LED banks is less by a factor of 10 than the percentage of the relative current from the constant current source provided respectively to each of the LED banks. While this example uses a minimum dimming current as 10% of the peak current, the minimum dimming current could be any desired value within a range, for example, between about 10% and about 50%.

While this methodology is described in terms of reduced pulse widths using a constant current source with PWM or TDM timing, other methods for controlling the amount of on-time current for driving the LEDs could be employed. Pulse density modulation (PDM) or pulse amplitude modification (PAM) would be examples.

In implementing the disclosed methodology according to the circuit arrangement of FIG. 1, common, low-cost elements may be used. For example, the switching and control elements for color mixing may be implemented with a MOSFET or similar semiconductor FET. These devices are inexpensive and do not have inherent settling time issues of a linear or switch-mode regulator that would be required in other approaches to dimming and color mixing.

Implementation of these concepts is not limited to the arrangement of FIG. 2 and various electronic circuits for achieving the features described in this disclosure is within the knowledge and experimentation of those of ordinary skill in the art.

In another example of implementing the improved dimming and color mixing methodology, the modulation process, whether PWM, PDM or another process, is selected to overcome interference from possible beat frequencies and subharmonics. In North America, line voltage is provided at 60 Hz, while in Europe the standard is 50 Hz. The constant current source can produce a ripple current and subsequent ripple voltage of a frequency that substantially corresponds to the AC line frequency. In particular, single-stage LED drivers, and even in some cases multiple-stage LED drivers, will have an inherent ripple frequency at twice the AC line frequency, i.e. 120 Hz in North America and 100 Hz in Europe.

To help avoid beat frequencies and subharmonics that may arise, the modulation process of the disclosed embodiments may operate at a frequency equal to a fixed multiple, greater than one, of the inherent ripple frequency of the constant current generator. Thus, for PWM (or similar) modulation, the switching may operate at a fixed multiple of this ripple frequency, i.e. about 1200 Hz in North America or 1000 Hz in Europe. This synchronization helps eliminate forming a beat frequency between the constant current source and the PWM modulator 112, which can lead to undesired flicker in the light output of the LEDs.

Figure 6:
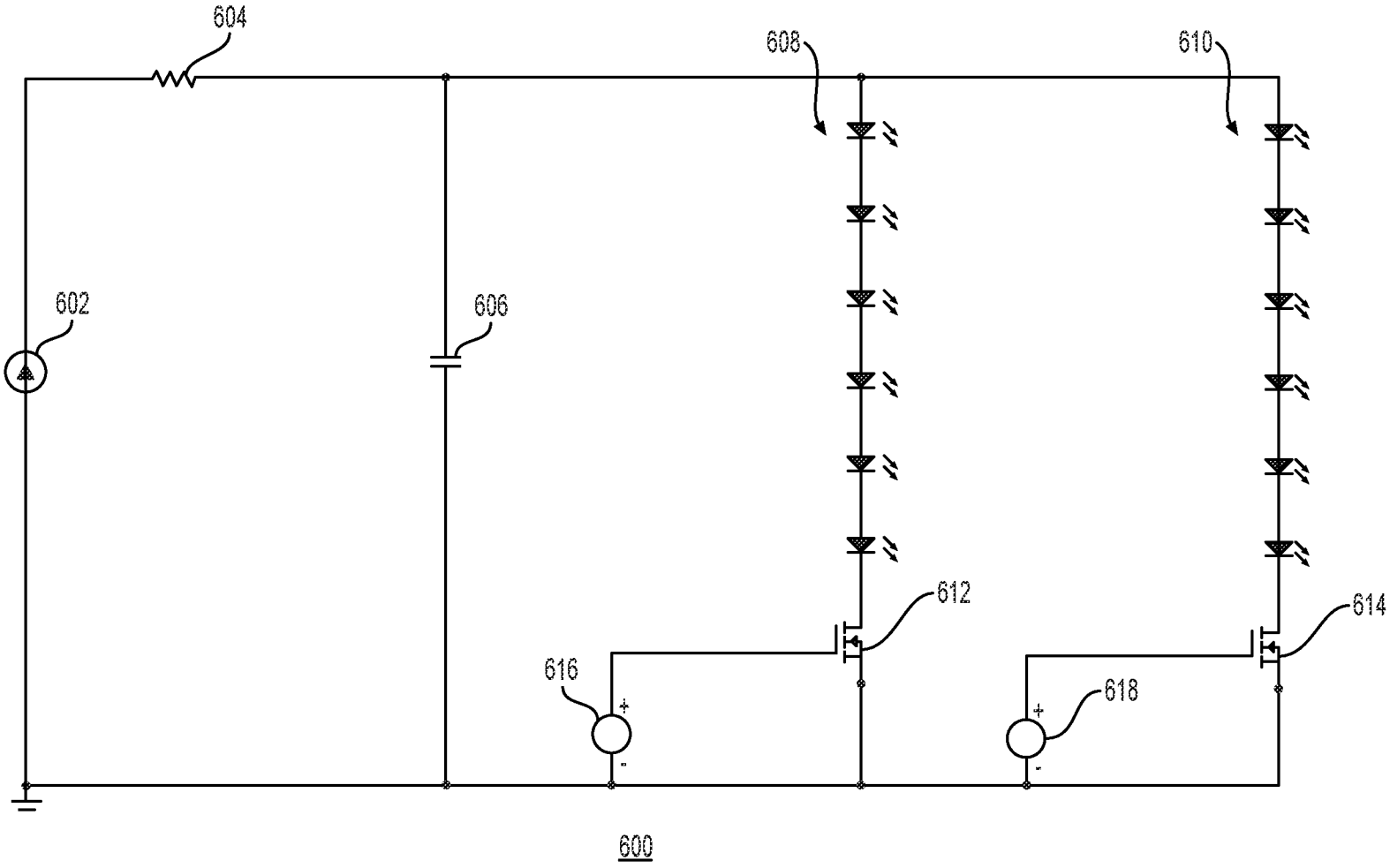
FIG. 6 is a circuit for simulating a mixing and dimming apparatus consistent with an example of the disclosure.

FIG. 6 is a general schematic diagram of a circuit 600 used to simulate a simplified version of circuit 200. Simulated elements include constant current source 602, resistance 604, voltage storage element 606, a first string of LEDs 608, a second string of LEDs 610, switches 612 and 614, a switching signal generator 616 for LEDs 608, and a switching signal generator 618 for LEDs 610.

Figure 7:
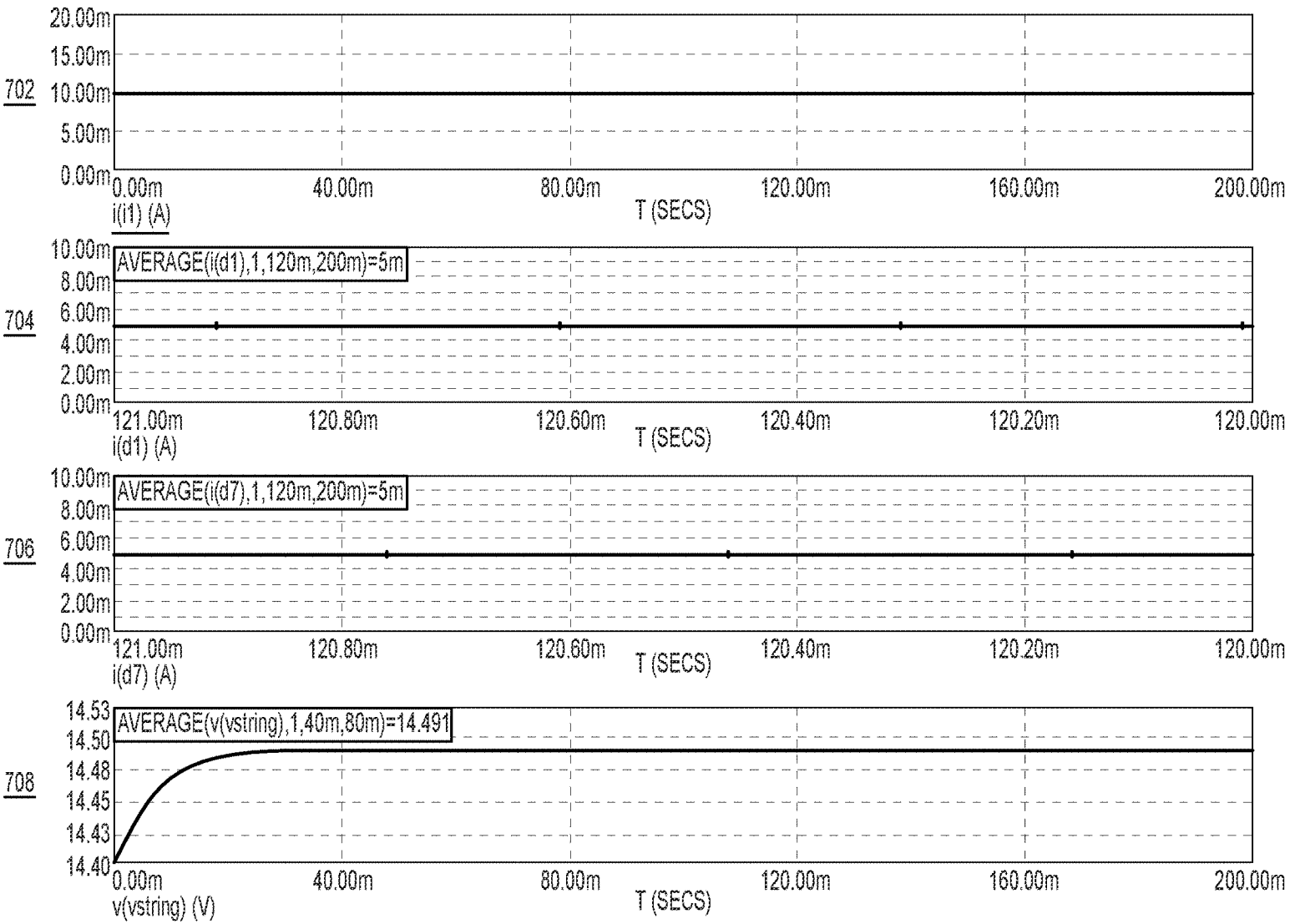
FIG. 7 are timing diagrams of simulation results of the circuit in FIG. 6 driven at 100% duty cycle consistent with an example of the disclosure.

FIG. 7 contains four graphs showing the simulation results when the switching signal generators 616 and 618 are operated at 100% duty cycle with a 1:1 mixing ratio for both LED strings 608 and 610. That is, switching signal generators 616 and 618 keep switches 612 and 614 in an on state, and a constant current is supplied over time to LEDs 608 and 610. As shown in graph 702, the constant current from source 602 was set at 10 mA. Graph 704 shows that the current through the first string of LEDs 608 was equal to about 5 mA, which is well below the current at which the optical performance of the LEDs would be guaranteed. Graph 706 shows that the current through the second string of LEDs 610 was also about 5 mA. The fourth graph 708 in FIG. 7 shows that the voltage at the top of the LED strings, i.e. the voltage across capacitor 606 and across the two strings of LEDs 608 and 610, was 14.491 V.

Figure 8:
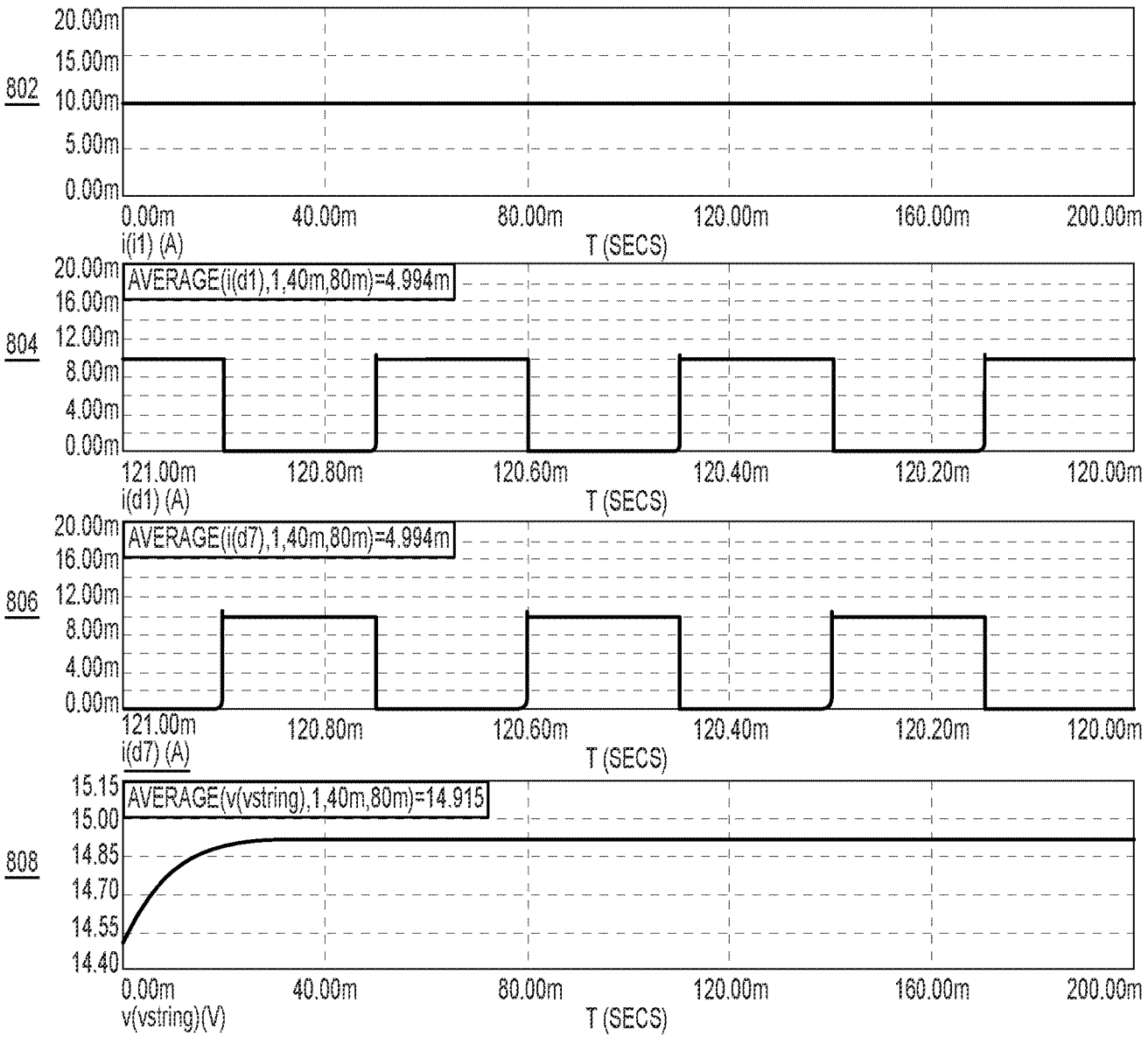
FIG. 8 are timing diagrams of simulation results of the circuit in FIG. 6 driven at 50% duty cycle consistent with an example of the disclosure.

FIG. 8 below contains four graphs showing the simulation results when switching signal generators 616 and 618 are operated at 50% duty cycle with a 1:1 mixing ratio for both strings of LEDs 608 and 610, such as with TDM modulation. As shown in the first graph 802, the constant current from source 602 was set at 10 mA. Graph 804 in FIG. 8 shows that with the current through the first string of LEDs 608 at 10 mA and modulated at a 50% duty cycle, the average current i(d1) through LEDs 608 was 4.994 mA. The third graph 806 shows the same information for current through the second string of LEDs 610. The fourth graph 808 shows that the average voltage across both strings of LEDs 608 and 610, was 14.915 V.

Figure 9:
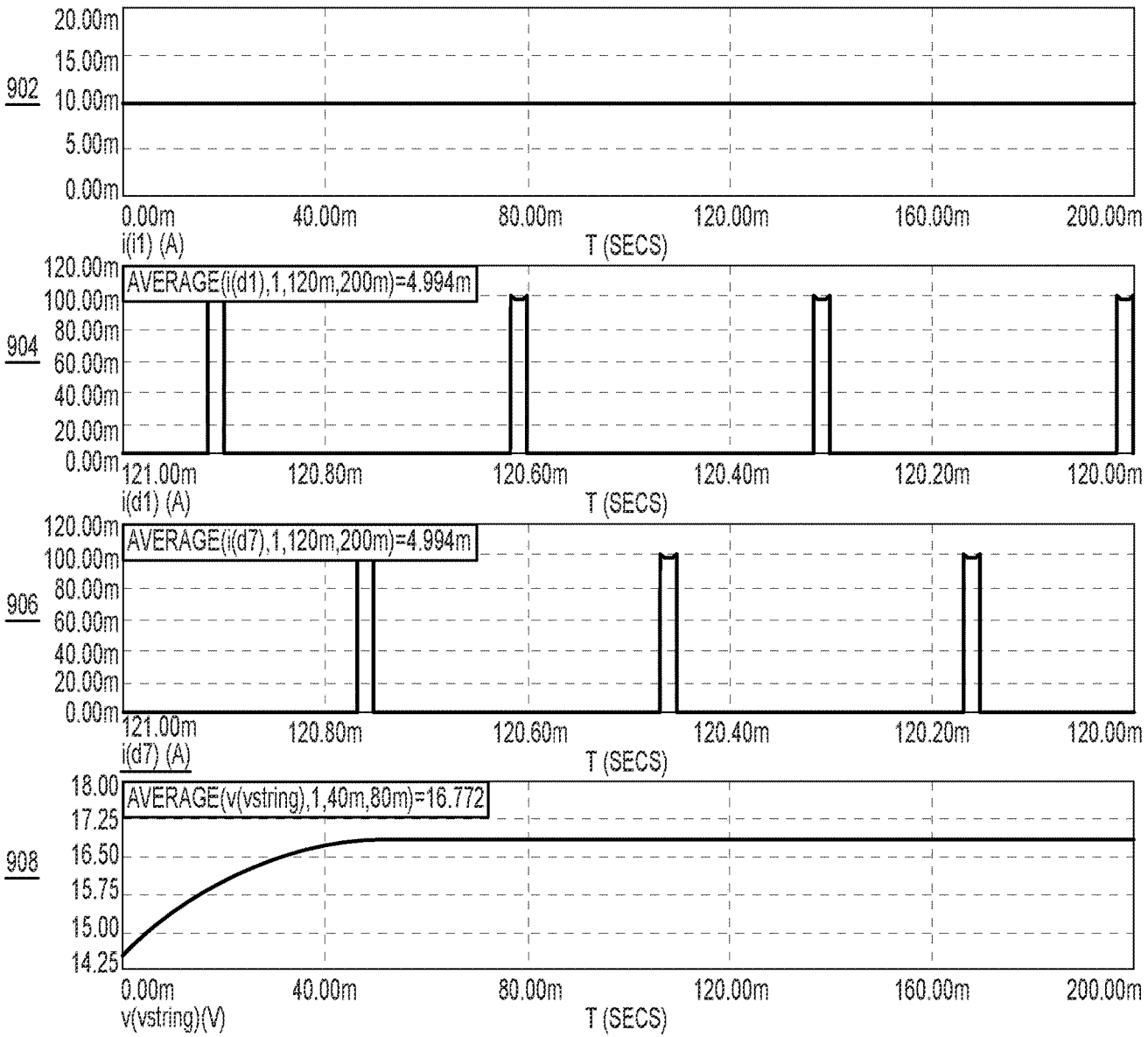
FIG. 9 are timing diagrams of simulation results of the circuit in FIG. 6 driven at 5% duty cycle consistent with an example of the disclosure.

FIG. 9 below contains four graphs showing the simulation results when switching signal generators 616 and 618 operate at 5% duty cycle with a 1:1 mixing ratio for both strings of LEDs 608 and 610, such as with TDM modulation. As shown in graph 902, the constant current from source 602 was again set at 10 mA. The second graph 904 shows the current through the first string of LEDs 904 at 10 mA modulated at a 5% duty cycle. The average current i(d1) through LEDs 904 was 4.994 mA, which is unchanged from the other simulations. Due in part to capacitor 606, the peak current for each of the shorter pulses at a 5% duty cycle was about 20 times the average current, or roughly 100 mA. The third graph 906 shows the same information for current through the second string of LEDs 610. Graph 908 shows that the average voltage across the strings of LEDs 608 and 610 was 16.772 V.

As indicated by FIG. 9, to compensate for the reduced duty cycle, the constant current circuit will automatically raise its output voltage to 16.772 V, which is the required string voltage to achieve 10 mA total average current with a 5% duty cycle per string. This causes the LEDs to operate closer to their binning current and achieve significantly better string-to-string matching than in the previous simulations.

In another aspect, the disclosed embodiment includes a system for wirelessly interacting with the dimming and mixing apparatus to adjust the light output. In different implementations, the dimming and mixing apparatus may be connected wirelessly to a computer network, such as to a local hotspot or router by way of WiFi, which in turn is connected to a device for measuring light emission from the LEDs. Based on measurements of the light emission, the device may execute a process to identify corrections or adjustments to be made by the dimming and mixing apparatus, and the corrections or adjustments may be fed back to the apparatus via the computer network and wireless connection. In other implementations, the dimming and mixing apparatus may be connected wirelessly directly to the measuring and correcting device using near-field communication (NFC), Bluetooth, or other short-range wireless point-to-point capability. This connectivity would provide potentially a calibration system or interface.

In one example, the wireless connection with the dimming and mixing apparatus may be used for programming static settings and verifying static settings with the apparatus or components within the apparatus, such as an LED driver. In this context, communication electronics within the dimming and mixing apparatus readily known to those of skill in the art may enable the wireless sending and receiving of operational settings for the apparatus between the apparatus and the computer, smartphone, or similar device. Similarly, the apparatus may download run-time data from the LED driver or other information to a user or maintenance individual operating the computer, smartphone, or similar device.

In a different implementation, the communication electronics within the dimming and mixing apparatus may be used to communicate settings and operational conditions of the apparatus in the context of tuning and calibrating the apparatus in a closed-loop configuration. Those adjustments may include, for example, changes to the minimum dimming current permitted, changes to the dimming current from the first dimming stage, or changes to the switching rate of the second mixing stage for the apparatus. It will be understood that the types of adjustments and the reasons for them are without limitation and may commonly include things such as customizing lighting comfort in the field, ensuring production consistency during manufacturing, or optimizing parameters for a user's specific application for the LEDs. Furthermore, the system is such that the user could have alternative settings to dimming and mixing modes; enabling users a level of mixing/dimming customization which can help with user experience and wellbeing.

The measuring and adjusting device in the closed-loop configuration may include automatic sensing equipment for deciding what adjustments should be made. For instance, a set of optical sensors would detect characteristics of the actual light output provided by a bank of LEDs. Computer hardware or software would calculate adjustments to be made to the dimming and color mixing apparatus to match a programmed level and would communicate new settings to the apparatus to attain that level. With this feedback, the optical sensing and calibrating system could automatically achieve the color balance and dimming conditions without judgment or significant involvement from a user.

The dimming and mixing apparatus disclosed herein may be applied for mixing colors of LEDs to obtain various balances of color, but also may be used where different types of white light LEDs are used together with color-specific LEDs. This arrangement may be used to produce more natural looking light. Overall, the primary application of such light mixing is to create and tune with high accuracy "human-centric" lights used for lighting purposes.

In addition, the dimming and mixing apparatus disclosed herein may also be applied to LEDs for different purposes. For example, mixing of colors for light of different balance may be used to improve LED usage for horticulture to enhance growth periods of plants. Also, the dimming and mixing methodology may help advance LED usage for safety, such as strobe lights for crowd dissipation that may help resolve issues with potential human seizures from the strobing. Further, the low-cost methodology of these techniques for white point and color implementation may help improve LED backlights used for display purposes. Other applications will be within the knowledge and routine experimentation of those of ordinary skill in the art.

Although this subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A system, comprising:

a current source arranged to provide a substantially constant amplitude of direct current;

a voltage storage element connected in parallel with the current source;

a light emitting diode (LED) load connected in parallel to the current source, comprising:

a first light emitting diode (LED) string comprising a first LED in series with a first electronic switch; and a second LED string comprising a second LED in series with a second electronic switch; and an electronic controller configured to operate in different modes in response to a dimming control signal to selectively enable the first electronic switch and the second electronic switch, wherein in a minimum dimming mode, the electronic controller is configured to provide a first mixing pulse at a pulse rate to the first electronic switch and a second mixing pulse at the pulse rate to the second electronic switch, a combined width of the first mixing pulse and the second mixing pulse being equal to the period of the pulse rate, and wherein in a maximum dimming mode, the electronic controller is configured to provide a first mixing-dimming pulse at the pulse rate to the first electronic switch and a second mixing-dimming pulse at the pulse rate to the second electronic switch, a combined width of the first mixing-dimming pulse and the second mixing-dimming pulse being less than a period of the pulse rate.

2. The system of claim 1, wherein the electronic controller is configured to apply the maximum dimming mode in response to the direct current being less than a predetermined minimum drive current.

3. The system of claim 1, wherein the predetermined minimum drive current is a value at which light emission for the first LED and light emission for the second LED become nonuniform.

4. The system of claim 1, wherein the first LED and the second LED have a rated current, and the predetermined minimum drive current is approximately 10% of the rated current.

5. The system of claim 1, wherein the electronic controller is configured to apply a minimum dimming mode for the LED load in response to the dimming control signal, wherein the combined width of the first mixing pulse and the second mixing pulse in the minimum dimming mode is equal to the period of the pulse rate.

6. The system of claim 5, wherein the electronic controller is configured to apply the minimum dimming mode in response to the direct current being greater than or equal to the predetermined minimum drive current.

7. The system of claim 5, wherein for the minimum dimming mode, the current source decreases the substantially constant amplitude of the direct current to cause dimming of the LED load.

8. The system of claim 1, wherein the dimming control signal is indicative of a dimming current for the first LED, and wherein a width of the first mixing-dimming pulse equals (a width of the first mixing pulse)*(the dimming current/the predetermined minimum drive current).

9. The system of claim 1, wherein the voltage storage element causes amplitudes of the first mixing-dimming pulse and the second mixing-dimming pulse to be larger than the first mixing pulse and the second mixing pulse.

10. The system of claim 1, wherein the first electronic switch and the second electronic switch are field-effect transistors (FETs), MOSFETs, or bipolar junction transistors (BJTs).

11. A method of mixing and dimming light emitting diodes (LEDs), comprising:

providing a substantially constant amplitude of direct current to an LED load comprising a plurality of LED banks having a predetermined minimum rated current;

capacitively storing a voltage across the LED load;

passing the direct current selectively through the plurality of LED banks for durations during a mixing period, a combination of the durations being equal to the mixing period;

receiving a dimming instruction indicative of a dimming current for the plurality of LED banks;

in response to the dimming current being greater than or equal to the predetermined minimum rated current, decreasing the substantially constant amplitude of the direct current; and in response to the dimming current being less than the predetermined minimum rated current, decreasing the substantially constant amplitude of the direct current and decreasing the combination of the durations to be less than the mixing period.

12. The method of claim 10, wherein passing the direct current selectively through the plurality of LED banks comprises controlling activation of one or more switches to turn on respective ones of the plurality of LED banks.

13. The method of claim 11, wherein controlling activation of the one or more switches comprises applying a modulated drive signal to the one or more switches.

14. The method of claim 10, wherein decreasing the combination of the durations to be less than the mixing period comprises decreasing the combination of the durations by a factor of (the dimming current)/(the predetermined minimum rated current).

15. A method, comprising:

delivering, from a current source, a substantially constant direct current to a load, the load comprising a light emitting diode (LED) enabled by a switch and at least another LED connected in parallel with the LED;

storing, with a capacitive element, a voltage level across the load;

activating the switch for a mixing duration equal to a percentage of a mixing period;

determining a dimming level for the LED and a selected minimum drive current for the LED as percentages of a rated current for the LED;

comparing the dimming level and the selected minimum drive current; and in response to the dimming level being less than the selected minimum drive current, dimming the LED by decreasing the substantially constant direct current to equal the dimming level and activating the first switch for a mixing-dimming duration equal to (the mixing duration)*(the dimming level/the selected minimum drive current).

16. The method of claim 15, wherein another switch enables the another LED, further comprising:

activating the another switch for another mixing duration, wherein the mixing duration and the another mixing duration equal the mixing period.

17. The method of claim 15, further comprising receiving a dimming control signal indicative of the dimming level for the LED;

determining, from the dimming control signal, the dimming level for the LED.

18. The method of claim 15, further comprising:

in response to the dimming level being greater than or equal to the selected minimum drive current, dimming the LED by decreasing an amplitude of the substantially constant direct current.

19. The method of claim 15, wherein the mixing-dimming duration and the capacitive element, at least in part, cause a current pulse for the LED in excess of the selected minimum drive current.

20. The method of claim 15, wherein activating the switch further comprises driving the switch with a pulse-wave-modulated signal having a duty cycle of the mixing duration.

* * * * *